United States Patent [19]

Reusser

[11] 4,070,299

[45] Jan. 24, 1978

[54] AZEOTROPIC COMPOSITIONS

[75] Inventor: Robert E. Reusser, Bartlesville, Okla.

[73] Assignee: Phillips Petroleum Company, Bartlesville, Okla.

[21] Appl. No.: 773,235

[22] Filed: Mar. 1, 1977

Related U.S. Application Data

[60] Division of Ser. No. 609,115, Aug. 29, 1975, Pat. No. 4,035,258, which is a division of Ser. No. 391,663, Aug. 27, 1973, Pat. No. 3,936,387, which is a continuation-in-part of Ser. No. 223,779, Feb. 4, 1972, abandoned.

[51] Int. Cl.[2] ..... C11D 7/50; C11D 7/30; C23G 5/02

[52] U.S. Cl. ..... 252/171; 134/38; 134/40; 252/305; 252/364; 252/DIG. 9

[58] Field of Search ..... 252/171, 170, 162, 364, 252/305, 67, DIG. 9; 134/38, 40; 62/114; 106/311; 203/67; 260/653, 653.5

[56] References Cited

U.S. PATENT DOCUMENTS 4,035,258 7/1977 Reusser ..... 252/171

*Primary Examiner*—Harris A. Pitlick

[57] ABSTRACT

This invention relates to azeotropic compositions of 1,2-dichloro-1-fluoroethane or of 1,2-dichloro-1,2-difluoroethane with certain alcohols, ethers, or ketones.

7 Claims, No Drawings

AZEOTROPIC COMPOSITIONS

This is a divisional application of Ser. No. 609,115, filed Aug. 29, 1975, now U.S. Pat. No. 4,035,258 which is a divisional application of Ser. No. 391,663, filed Aug. 27, 1973, now U.S. Pat. No. 3,936,387, Feb. 3, 1976; which is a continuation-in-part of Ser. No. 223,779, filed Feb. 4, 1972, now abandoned.

FIELD OF THE INVENTION

This invention relates to azeotropic compositions of chlorofluorohydrocarbons with alcohols, ethers, or ketones. In a further aspect, the invention relates to new solvent compositions. In another aspect, the invention relates to methods of removing excess solder flux from circuit boards.

BACKGROUND OF THE INVENTION

Azeotropic mixtures are liquid mixtures of two or more substances which mixtures behave like single substances in that the vapor produced by partial evaporation of the azeotropic liquid has the same composition as does the liquid. Azeotropic compositions exhibit either a maximum or minimum boiling point as compared with that of other but non-azeotropic mixtures of the same substances or components.

Chlorofluorohydrocarbons have found usage for a variety of purposes. For some solvent purposes, however, the chlorofluorohydrocarbons in themselves have not exhibited adequate abilities. Particularly deficient have been the chlorofluorohydrocarbons in dissolving excess solder flux from printed circuits. Printed circuits are formed from a soft metal on a solid nonconducting surface such as a reinforced phenolic resin. During the manufacturing processes, the solid surface or support is coated with the soft metal. The particular desired portion or configuration of metal is coated with an acid-impervious protective coating, and the excess unprotected metal is removed by an acid etching process.

The protective coating subsequently must be removed since solder joints must ultimately be made onto the printed circuit. After the impervious coating is removed, the circuits are coated with a rosin flux to permit the joints to be soldered, and after soldering the rosin flux itself must be removed. For removal of such coatings and fluxes, highly efficient uniform composition solvents are desirable.

OBJECTS OF THE INVENTION

It is an object of this invention to provide novel azeotropic compositions.

It is a further purpose of this invention to provide new compositions of matter useful for dissolving solder flux.

Other aspects, objects, and the several advantages of my invention will be readily apparent to one skilled in the art to which the invention most nearly pertains from the reading of my description and consideration of my appended claims.

DESCRIPTION OF THE INVENTION

I have discovered useful azeotropes of 1,2-dichloro-1-fluoroethane with each of the tetrahydrofuran, methyl ethyl ketone, methanol, ethanol, isopropanol; and of 1,2-dichloro-1,2-difluoroethane with each of tetrahydrofuran, methyl ethyl ketone, acetone, ethanol, and isopropanol.

An azeotrope may be defined as a constant boiling mixture which distills without change in composition. Yet, at a differing pressure, the composition indeed may vary, at least slightly, with the change in distillation pressure, which also changes, at least slightly, the distillation temperature. An azeotrope of A and B may represent a unique type of relationship with a variable composition.

Thus, it should be possible to fingerprint the azeotrope, which may appear under varying guises depending upon the conditions chosen, by any of several criteria: The composition may be defined as an azeotrope of A and B, since the very term azeotrope is at once definitive and limitative, requiring that A and B indeed form this unique composition of matter which is a constant boiling admixture. Or, the composition may be defined as a particular azeotrope of a weight percent relationship or mole percent relationship of A:B, but recognizing that such values point out only one such relationship, whereas a series of relationships of A:B may exist for the azeotrope, varied by influence of temperature and pressure. Or, recognizing that broadly speaking an azeotrope of A:B actually represents a series of relationships, the azeotropic series represented by A:B may in effect be fingerprinted or characterized by defining the composition as an azeotrope further characterized by a particular boiling point at a given pressure, thus giving identifying characteristics without unduly limiting the scope of the invention.

EXAMPLES

The following data are presented in order to assist in disclosing and describing my invention, and, therefore, are not intended to be limitative of the reasonable scope thereof.

The azeotropes of my invention were prepared by distilling mixtures of the chlorofluorohydrocarbon and the other component until the overhead temperature reached a constant value and the composition of the distillate remained unchanged as verified by GLC analysis, thereby establishing the existence of a minimum boiling azeotrope in each case.

The azeotropes were tested as solvents for solder flux on printed circuits.

EXAMPLE I

Azeotropic compositions were prepared and characterized by the properties tabulated below:

TABLE I

| Azeotrope[a] B.P. | (Pressure) | Chlorofluoro-hydrocarbon | Alcohol | Composition of Azeotrope Chlorofluoro- | hydro-carbon-/Alcohol |
|---|---|---|---|---|---|
| 56° C | (742 mm) | 141[b] | Methanol | (73.5/26.5<br>(64.4/35.6 | wt. %<br>area % |
| 65° C | (749 mm) | 141 | Ethanol | 81.2/18.8 | wt. % |

TABLE I-continued

| Azeotrope[a] B.P. | (Pressure) | Chlorofluoro-hydrocarbon | Alcohol | Composition of Azeotrope Chlorofluoro- | hydrocarbon-/Alcohol |
|---|---|---|---|---|---|
| 68° C | (740 mm) | 141 | Isopropanol | 81.3/16.6[d] | wt. % |
| 52° C | (741 mm) | 132[c] | Methanol | 90.4/9.6 | wt. % |
| 56–57° C | (748 mm) | 132 | Ethanol | 94.9–95/5–5.1 | wt. % |
| 47° C | (744 mm) | 132 | Isopropanol | 98.7/1.3 | wt. % |

[a]B. P. is the boiling point for the azeotropic composition at substantially atmospheric in each case. The pressure showing was the atmospheric barometric pressure taken from daily laboratory readings.
[b]141 represents 1,2-dichloro-1-fluoroethane
[c]132 represents 1,2-dichloro-1,2-difluoroethane
[d]Remaining 2.1 weight per cent not identified.

The azeotropes were tested as solvents for removal of solder flux from commercial circuit boards, with results as shown below, along with comparative runs:

TABLE II

| Runs | Solvent Systems | Wt. % of Flux Dissolved |
|---|---|---|
| 1 | 141/methanol | 97.0 |
| 2 | 141/ethanol | 91.5 |
| 3 | 141/isopropanol | 95.7 |
| 4 | 132/methanol | 98.7 |
| 5 | 132/ethanol | 94.0 |
| 6 | 132/isopropanol | 98.0 |
| 7 | 113[e] | 28.4 |
| 8 | 1,1,1-trichloroethane | 82.6 |
| 9 | 113/ethanol azeotrope | 66.5 |
| 10 | 113/ethanol/acetone azeotrope | 57.0 |
| 11 | 113/isopropanol azeotrope | 69.5 |
| 12 | 141 | 51.3 |
| 13 | 132 | 74.2 |

[e]113 represents 1,1,2-trichloro-1,2,2-trifluoroethane.

The data in Table II show that the novel azeotropic compositions of this invention were more effective than several commercially available solvents or of 141 or 132 alone in removing solder flux from printed circuit boards.

EXAMPLE II

Azeotropic compositions were prepared and characterized by the properties tabulated below:

TABLE III

| Azeotrope B.P. | (Pressure) | Chlorofluoro-hydrocarbon | Ether | Approximate Weight Per Cent Composition of Azeotrope Chlorofluoro-hydrocarbon/Ether |
|---|---|---|---|---|
| 74° C | (739 mm) | 141 | THF[f] | 61.8/38.2 |
| 70° C | (739 mm) | 132 | THF | 45.9/54.1 |

[f]THF represents tetrahydrofuran.

The azeotropes were tested as solvents for removal of solder flux from commercial circuit boards, with results as shown below, along with comparative runs with other similar materials.

TABLE IV

| Runs | Solvent Systems | Wt. % of Flux Dissolved |
|---|---|---|
| 14 | 141/THF | 100 |
| 15 | 132/THF | 100 |
| 16 | 1,1,1-Trichloroethane | 82.6 |
| 17 | 113/ethanol azeotrope | 66.5 |
| 18 | 141 | 51.3 |
| 19 | 132 | 74.2 |

The data in Table IV above show that the novel azeotropic compositions of this invention were more effective in removing solder flux from printed circuit boards than several commercially available solvents or 141 or 132 alone.

EXAMPLE III

Azeotropic compositions were prepared and characterized by the properties tabulated below:

TABLE V

| Azeotrope B.P. | (Pressure) | Chlorofluoro-hydrocarbon | Ketone | Approximate Wt. % Composition of Azeotrope Chlorofluoro-hydrocarbon/Ketone |
|---|---|---|---|---|
| 80° C | (atmospheric) | 141 | MEK[g] | 54.1/45.9 |
| 80° C | (743 mm) | 132 | MEK | 39.8/60.2 |
| 66° C | (736 mm) | 132 | Acetone | 72.3/27.7 |

[g]MEK represents methyl ethyl ketone.

The azeotropes were tested as solvents for removal of excess solder flux from commercial circuit boards, with the results as shown below, along with comparative runs with other materials.

TABLE VI

| Runs | Solvent Systems | Wt.% of Flux Dissolved |
|---|---|---|
| 20 | 141/MEK | 100 |
| 21 | 132/MEK | 98 |
| 22 | 1,1,1-Trichloroethane | 82.6 |
| 23 | 113/ethanol azeotrope | 66.5 |
| 24 | 113/ethanol/acetone azeotrope | 57.0 |
| 25 | 141 | 51.3 |
| 26 | 132 | 74.2 |

The data in Table VI above show that the novel azeotropic compositions of this invention were more effective in removing solder flux from printed circuit boards than several commercially available solvents or 141 or 132 alone.

EXAMPLE IV

Flash point data were obtained for azeotropic compositions of my discovery:

TABLE VII

| Run No. | Azeotrope | Azeotrope Flash Point, ° F[h] | Flash Point of alcohol, ether or ketone[i] Component Alone |
|---|---|---|---|
| 27 | 141/methanol | 46° F | 51° F |
| 28 | 141/ethanol | 75° F[j] | 56° F |
| 29 | 141/isopropanol | — | 53° F |
| 30 | 132/methanol | 46° F | 51° F |
| 31 | 132/ethanol | 75° F[k] | 56° F |
| 32 | 132/isopropanol | 75° F[l] | 53° F |
| 33 | 141/THF | 40° F | 6° F |
| 34 | 132/THF | 36° F | 6° F |
| 35 | 141/MEK | — | 23° F |
| 36 | 132/MEK | 42° F | 23° F |
| 37 | 132/Acetone | 45° F | 15° F |

[h]Flash point determination in accordance with ASTM Method D-56.
[i]Flash point data obtained from Shell Chemical Co. Brochure IC-71-18.
[j]Burned at 75° F, not self-extinguishing.
[k]Did not burn at 75° F; supported combustion of vapors and air, but was self-extinguishing.
[l]Did not burn at 75° F; did not support combustion, but was self-extinguishing.

Data on two azeotropes were not obtained as indicated by the dashes above. The flash point data in general show that the inventive azeotropes are less hazardous in most cases than the alcohol, ether, or ketone non-chlorofluorohydrocarbon component alone. The azeotropes in most cases have higher flash points than does the second component alone.

It will be understood that the description given hereinabove of the use of azeotropic compositions of my invention in cleaning or dissolving solder flux is given for illustrative purposes only, that the invention itself is not restricted to such specific embodiments, and that other techniques may be employed. These unique azeotropic compositions will have applications as solvents for greases, oils, waxes, aerosol propellants, and the like; and in cleaning electric motors, compressors, photographic film, oxygen storage tanks, lithographic plates, typewriters, precision instruments, gauges, sound tape, cloth, clothing, and the like. It will be readily apparent that the novel azeotropic compositions can be used for a variety of purposes as indicated by my general description and suggestions.

I claim:

1. An azeotrope of (A) 1,2-dichloro-1-fluoroethane and (B) one of isopropanol, tetrahydrofuran, or methyl ethyl ketone.

2. The azeotrope according to claim 1 which at substantially atmospheric pressure is characterized as about 81.3 weight percent 1,2-dichloro-1-fluoroethane and about 16.6 weight percent isopropanol.

3. The azeotrope according to claim 2 characterized by a boiling point of about 68° C. at about 740 millimeters pressure.

4. The azeotrope according to claim 1 which at substantially atmospheric pressure is characterized as about 61.8 percent 1,2-dichloro-1-fluoroethane and about 38.2 weight percent tetrahydrofuran.

5. The azeotrope according to claim 4 characterized by a boiling point of about 74° C. at about 739 millimeters pressure.

6. The azeotrope as defined in claim 1 which at substantially atmospheric pressure is characterized as about 54.1 weight percent 1,2-dichloro-1-fluoroethane and about 45.9 weight percent methylethyl ketone.

7. The azeotrope according to claim 6 characterized by a boiling point of about 80° C. at substantially atmospheric pressure.

* * * * *